US006610119B2

(12) United States Patent
Klarstrom

(10) Patent No.: US 6,610,119 B2
(45) **Date of Patent: *Aug. 26, 2003**

(54) NICKEL-MOLYBDENUM ALLOYS

(75) Inventor: Dwaine L. Klarstrom, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 22 days.

This patent is subject to a terminal disclaimer.

(21) Appl. No.: 09/951,700

(22) Filed: Sep. 13, 2001

(65) Prior Publication Data

US 2003/0091460 A1 May 15, 2003

Related U.S. Application Data

(63) Continuation of application No. 08/269,995, filed on Jul. 1, 1994, now Pat. No. 6,503,345.

(51) Int. Cl.[7] ..... C22C 19/03
(52) U.S. Cl. ..... 75/10.25; 148/676; 148/426
(58) Field of Search ..... 75/10.25; 148/676, 148/426

(56) References Cited

U.S. PATENT DOCUMENTS

| | | | |
|---|---|---|---|
| 1,710,445 | A | 4/1929 | Becket |
| 1,836,317 | A | 12/1931 | Franks |
| 1,924,245 | A | 8/1933 | Koster |
| 1,963,844 | A | 6/1934 | Holladay |
| 2,109,285 | A | 2/1938 | Brown |
| 2,196,699 | A | 4/1940 | Franks |
| 2,207,380 | A | 7/1940 | Kurtz |
| 2,237,872 | A | 4/1941 | Badger |
| 2,315,497 | A | 4/1943 | Brennan |
| 2,959,480 | A | 11/1960 | Flint |
| 3,649,255 | A | 3/1972 | Ecer |
| 4,496,635 | A | 1/1985 | Wang et al. |
| 4,818,486 | A | 4/1989 | Rothman et al. |
| 4,861,550 | A | 8/1989 | Yoshida et al. |
| 4,970,569 | A | 11/1990 | Mori et al. |

FOREIGN PATENT DOCUMENTS

| | | |
|---|---|---|
| GB | 810089 | 3/1959 |
| GB | 869753 | 6/1961 |
| JP | 58034155 | 2/1983 |

OTHER PUBLICATIONS

R. E. Clausing, P. Patriarca and W. D. Manly, "Aging Characteristics of HASTELLOY Alloy B"; Transactions of the ASM; 1958, vol. 51 pp. 123–135.

(List continued on next page.)

*Primary Examiner*—George Wyszomierski
(74) *Attorney, Agent, or Firm*—Buchanan Ingersoll, P.C.

(57) ABSTRACT

High molybdenum, corrosion-resistant alloys are provided with greatly increased thermal stability by controlling the atom concentrations to be $Ni_aMo_bX_cY_dZ_e$, where:

a is between about 73 and 77 atom percent b is between about 18 and 23 atom percent X is one or more required substitutional alloying elements selected from Groups VI, VII and VIII of the Periodic Table and c does not exceed about 5 atom percent for any one element, Y is one or more optional substitutional alloying elements which may be present and d does not exceed about one atom percent for any one element, Z is one or more interstitial elements and e is as tow as possible, not exceeding about 0.2 atom percent in total; and the sum of c and d is between about 2.5 and 7.5 atom percent.

6 Claims, 5 Drawing Sheets

OTHER PUBLICATIONS

G. N. Flint, "The Corrosion–Resistance of Welded Nickel–Molybdenum Alloys"; Journal of the Institute of Metals, 1959, vol. 87, pp. 303–310.

G. N. Flint, "The Corrosion–Resistance of Cast Nickel–Molybdenum–Iron Alloys"; Metallurgia, 1960, pp. 195–200.

T. V. Svistunova, Z. I. Runova and A. A. Sakharnov, "Knife–Edge Corrosion of Ni–Mo Alloys "; Central Scientific–Research Institute of Ferrous Metallurgy translated from Metallovedenie i Termicheskaya Obrabotka Metallov, No. 5, May 1970, pp. 2–6.

D. R. Roan and C. R. Brookes, "The Effect of Aging on the Mechanical Properties of a Nickel–Molybdenum–Iron Alloy (HASTELLOY B)"; Metallurgical Transactions A, 1975, vol. 6A, pp. 1829–1831.

F. G. Hodge and R. W. Kirchner, "An Improved Ni–Mo Alloy for Hydrochloric Acid Service"; Materials Performance, Aug. 1976, pp. 40–45.

C. R. Brooks, J. E. Spruiell and E. E. Stansbury, "Physical Metallurgy of Nickel–Molybdenum Alloys"; International Metals Reviews, 1984, vol. 29, No. 3, pp. 210–248.

Y. Takizawa and I. Sekine, "Stress Corrosion Cracking Phenomena on Ni–Mo Alloys in High Temperature Nonaqueous Solutions"; Corrosion 85, Paper No. 355, Mar. 1985.

U. D. Kulkarni and S. Banerjee, "Phase Separation During the Early Stages of Ordering in $Ni_3Mo$"; Acta Mettall., vol. 36, No. 2, 1988, pp. 413–424.

C. R. Brooks and Y. M. Wang, "Effect on the Microstructure of Aging HASTELLOY B2 from 550 to 850° C for 1200 Hours"; Metallography, No. 23, 1989, pp. 57–86.

H. M. Tawancy, "Effect of Minor Concentrations of Iron and Chromium on the Long–Range Ordering Behavior of a Ni–Mo Alloy" Journal of Materials Science Letters, No. 10, Jun. 1991, pp. 696–698.

H. M. Tawancy, "Ductilization of Ni–$Ni_4Mo$ Alloys by Boron Additions";Metallurgical Transactions A, vol. 22A , 1991, pp. 3067–3071.

Alloy Digest Ni–36, HASTELLOY Alloy B, Published by Engineering Alloys Digest, Inc., Aug. 1957.

Alloy Digest Ni–12, Chlorimet 2, Published by Engineering Alloys Digest, Inc., Oct. 1980.

Alloy Digest Ni–55, HASTELLOY Alloy N, Published by Engineering Alloys Digest, Inc., Feb. 1960.

Alloy Digest Ni–82, CORRONEL 220, Published by Engineering Alloys Digest, Inc., May 1963.

Alloy Digest Ni–249, HASTELLOY Alloy B–2, Published by Engineering Alloys Digest, Inc., Sep. 1977.

Alloy Digest Ni–353, HASTELLOY Alloy W, Published by Engineering Alloys Digest, Inc., Nov. 1977.

Alloy Digest Ni–399, HAYNES 242 Alloy, Published by Engineering Alloys Digest, Inc., Jan. 1992.

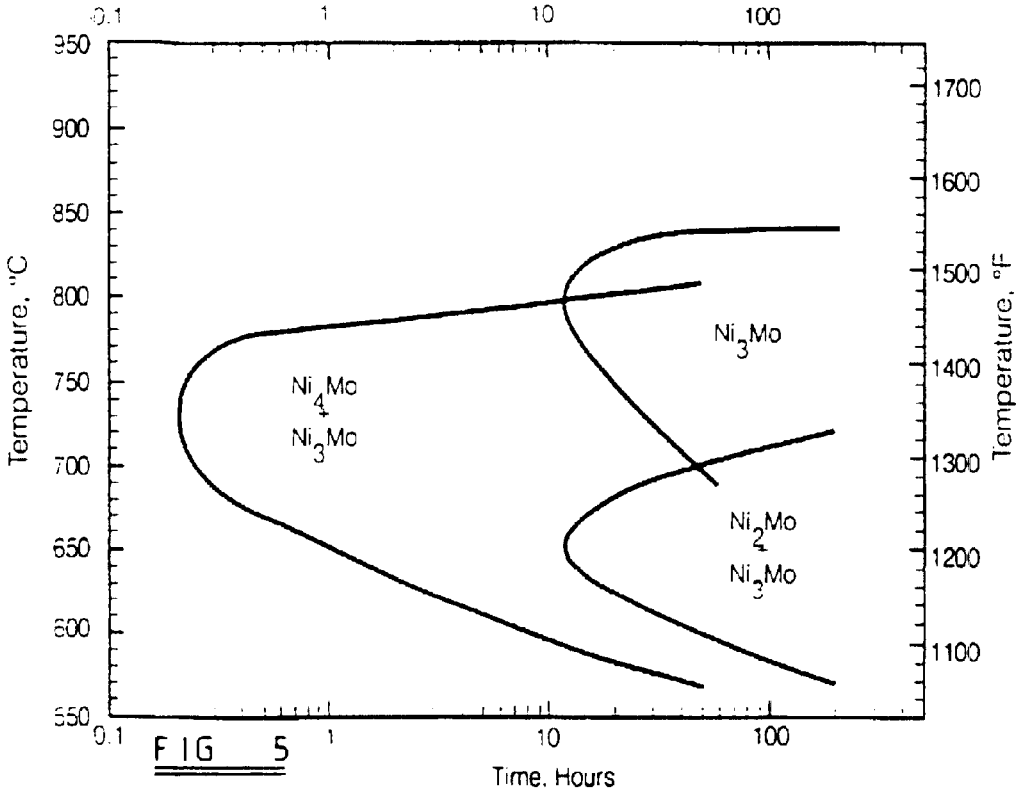
FIG 5
FIG 7
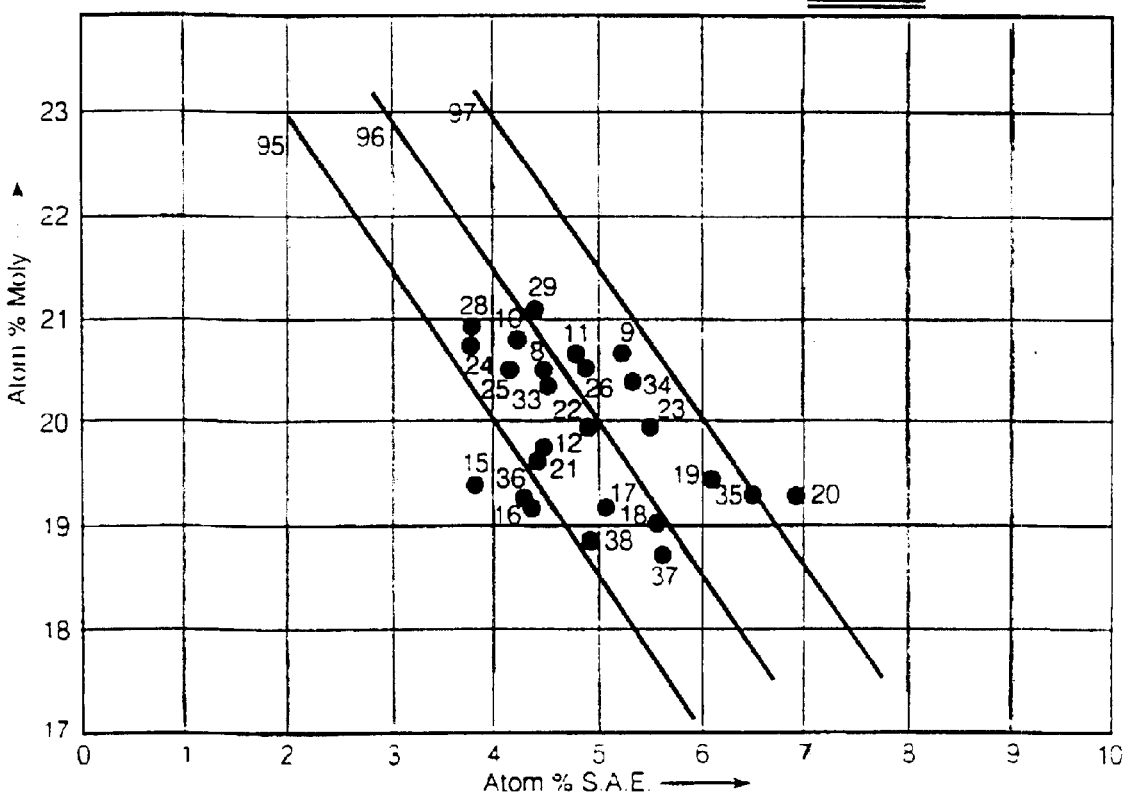

NICKEL-MOLYBDENUM ALLOYS

This is a continuation of U.S. patent application Ser. No. 08/269,995, filed Jul. 1, 1994, and now U.S. Pat. No. 6,503,345.

TECHNICAL FIELD

This invention relates generally to nickel-base alloy compositions and more specifically to a family of nickel-base alloys containing about 18 to 25 atom percent molybdenum in combination with low but critical amounts of certain other substitutional alloying elements which provide thermal stability to the metallurgical structure.

BACKGROUND ART

Early in the twentieth century, it was noticed that the addition of substantial amounts (above 15 percent) of molybdenum to nickel markedly improved nickel's resistance to corrosion by reducing acids such as acetic, hydrochloric or phosphoric acids. However, with increasing amounts of molybdenum, the alloys became much more difficult, if not impossible, to work into common shapes. Therefore, the first commercially available alloy of this type, called simply alloy "B", contained about 18 or 19 percent molybdenum (all concentrations herein are expressed in atomic percentages) along with significant amounts (7 to 12 percent) of iron (primarily from the use of ferromolybdenum in the manufacturing process, but also often added to reduce cost) as well as several percents of incidental additions or impurities including carbon, manganese and silicon. See, for example, U.S. Pat. No. 1,710,445 granted in 1929 to a predecessor of the present assignee.

While these alloys were relatively easy to cast into shapes, great difficulty was encountered in hot working them into plates and sheets for later fabrication into chemical vessels, piping and the like. During the 1940's, the developer of alloy B, Haynes Stellite Co., continued to work toward improving this alloy family and, among other things, determined that copper was one of the elements most detrimental to hot workability. As disclosed in U.S. Pat. No. 2,315,497, the corrosion rate was unaffected by keeping the copper content below about 0.15 percent. Therefore, even today, copper is maintained as low as possible and preferably below about 0.5 percent.

Such alloys had good resistance to wet corrosion by non-oxidizing acids so long as the formation of second phase precipitates was avoided. Such precipitates, usually forming along grain boundaries in the heat affected zones during welding, promoted rapid intergranular corrosion by depleting adjacent areas in molybdenum. Thus, all welded structures needed a solutionizing or stabilizing heat treatment (e.g., 1100° C. for one hour) followed by rapid cooling to suppress such corrosion. This effect is discussed in more detail in U.S. Pat. Nos. 2,237,872 and 2,959,480.

Since such heat treatment is expensive and even impossible for large welded structures, many attempts have been made to improve upon the basic "B" alloy to stabilize or even avoid such harmful precipitates.

During the 1950's, an extensive study was undertaken in England by G. N. Flint who, as reported in several publications and patents (see GB Patent No. 810,089 and U.S. Pat. No. 2,959,480), found that the harmful precipitates were carbides of the $M_6C$ type (either $Ni_3Mo_3C$ or $Ni_2Mo_4C$) which were dissolved by exposure to temperatures above 1200° C. during welding, then subsequently re-precipitated at grain boundaries during cooling.

Flint concluded that, while it is not practical to lower the carbon content enough to prevent all carbides, it is beneficial to lower the iron and silicon levels to increase its solubility somewhat. More importantly, he also thought that the excess carbon could be stabilized by the addition of several percent of vanadium and/or niobium which would form stable MC-type carbides that would be more resistant than $M_6C$ to dissolution and subsequent re-precipitation at the grain boundaries after welding. Thus, such a material was thought to be substantially free from intergranular corrosion in the softened-and-welded condition. However, it was noticed that corrosion could be induced adjacent the weld by a "sensitizing" heat treatment at 650° C. This fact was unappreciated until later.

A commercial version of the Flint alloy was introduced during the mid-1960's as HASTELLOY® alloy B-282, but soon was withdrawn from the market when it was shown to suffer not only severe intergranular corrosion, but also higher general corrosion rates than the old alloy B. It is generally believed that the difference in performance between Flint's laboratory samples and commercial wrought structures was due to the much higher levels of impurities in the commercial alloys (notably silicon and manganese) in combination with the longer times at higher temperatures required by the normal manufacturing process.

At about this same time, Otto Junker, in Germany, adapted Flint's findings about carbide control to cast alloys which had very low levels of carbon, silicon, iron or other impurities (e.g., manganese) and without vanadium (see GB Patent No. 869, 753). Wrought versions of this alloy were developed by the assignee of the present invention and sold under the name HASTELLOY alloy B-2, in place of the withdrawn alloy B-282.

During the last 30 years, most attempts to improve the performance of alloy B-2 have involved reducing the total level of impurities introduced during the melting process. (Although a few inventors have tried to add a magic element, no such alloys have been commercially acceptable. See, for example, U.S. Pat. No. 3,649,255 which adds B and Zr). Today's alloy B-2 is generally resistant to intergranular corrosion caused by carbide precipitation, but still may require an annealing heat treatment after certain other manufacturing operations.

It is now known that even relatively clean Ni—Mo alloys can develop complex second phases after exposure to temperatures in the range of 600–800° C. Such phases are not compounds containing other elements (like the carbide precipitates) but, rather, different crystalline microstructures, such as the ordered intermetallic phases $Ni_2Mo$, $Ni_3Mo$, and $Ni_4Mo$. Such phases are very brittle and provide for easy crack propagation along grain boundaries. Further, such phases cause the adjacent matrix to become depleted of molybdenum and thus have a lower corrosion resistance than the distant disordered fcc matrix, which explains the "sensitization" noticed by Flint after his heat-treatment of alloy B at 650° C.

While some increase in corrosion rates can be tolerated in most applications, the severe age embrittlement due to the ordering reaction often results in catastrophic failures in stressed structures (such as cold worked or welded vessels) exposed to these temperatures for even a short time. The kinetics of the ordering reaction in alloy B-2 are very rapid, compared to the ordering in lower molybdenum alloys. For example, U.S. Pat. No. 4,818,486 discloses a Ni—Mo—Cr alloy with about 17 atom percent molybdenum, which is said to have "excellent ordering characteristics after an aging time of only 24 hours."

It should be apparent from the foregoing that there has been a long-felt need in the art for a high molybdenum, nickel-base alloy which does not exhibit rapid, order induced, grain boundary embrittlement and, preferably, with no sacrifice in corrosion resistance.

SUMMARY OF THE INVENTION

The aim of the present invention is to overcome the disadvantages of the prior art as well as offer certain other advantages by providing a novel family of high molybdenum, nickel-base alloys having the general formula $Ni_aMo_bX_cY_dZ_e$ where:

X is one or more (preferably two or more) required substitutional alloying elements selected from Groups VI, VII or VIII of the Periodic Table;

Y is one or more undesirable but permissible other metallic substitutional alloying elements;

Z is any nonmetallic interstitial elements present;

a is the atom percent nickel and is more than about 73 but less than about 77 atom percent;

b is the atom percent molybdenum and is between about 18 and 23 atom percent;

c and d are the atom percents of the required and permissible substitutional alloying elements X and Y, respectively, where the total c is a least about two percent and c plus d is between about 2.5 and 7.5 atom percent, provided no one element X is present in amounts greater than about five atom percent and no one element Y is present in amounts greater than about one atom percent; and e is the atom percent of any interstitial element Z which may be present, and is as low as practical, but is tolerated up to a total amount of no more than about 0.2 atom percent.

This family of alloys is characterized by exhibiting greatly enhanced thermal stability, as well as superior corrosion resistance, as compared to the prior commercial alloy B-2.

Accordingly, the present invention also includes a process or method for increasing the thermal stability of high molybdenum, nickel-base alloys. This method includes, along with the usual steps manufacturing these alloys, the steps of determining the chemical composition of said alloy during the primary melting stage, determining the total amount of substitutional alloying elements present in the alloy at this stage, then, if necessary, adding additional alloying materials containing elements selected from Groups VI, VII or VIII of the Periodic Table in order to adjust the final composition to contain about: 73 to 77 atom percent nickel, 18 to 23 atom percent molybdenum, 2.5 to 7.5 atom percent in total of at least one but preferably two or more substitutional alloying elements, but no more than five percent of any one element, and any incidental impurities not significantly affecting the properties of the alloy.

Further, the total amount of substitutional alloying elements (SAE) present is preferably related to the total amount of molybdenum present by the equation: SAE plus 0.7 times molybdenum is between about 18 and 20. Therefore, to determine more closely the preferred amount of additional alloying materials to add during manufacturing, the equation may be rewritten as: SAE should be about 19 minus 0.7 times molybdenum concentration.

While the inventor does not wish to be held to any particular scientific theory, since the exact mechanisms are not clearly understood at this time, it is believed that the increase in thermal stability (as evidenced by the reduced rate of hardening at 700° C.), provided to these alloys by adding a low but carefully controlled amount of substitutional alloying element X, is due to the more stable electronic configuration of the intermediate transformation phases which seem to slow the ordering kinetics by favoring the formation of metastable $Ni_2(Mo, X)$ rather than $Ni_3(Mo, X)$ or $Ni_4Mo$ within the metallurgical crystal structure. Of course, even metastable $Ni_2Mo$ should eventually degenerate into other phases, such as $Ni_4Mo$, but any delay is usually beneficial for fabricators of the alloy.

BRIEF DESCRIPTION OF THE DRAWINGS

While this specification concludes with claims particularly pointing out and distinctly claiming the subject matter which is presently regarded as the invention, it is believed that several of the features and advantages thereof may be better understood from the following detailed description of presently preferred embodiments, when taken in connection with the accompanying drawings, in which:

FIG. 5 is a time-temperature-transformation diagram for an alloy of the present invention compared to a prior art B-2 alloy;

FIG. 7 is a graph of a relationship between molybdenum content and preferred amounts of substitutional alloying elements.

PREFERRED EMBODIMENTS OF THE INVENTION

Figure 1:
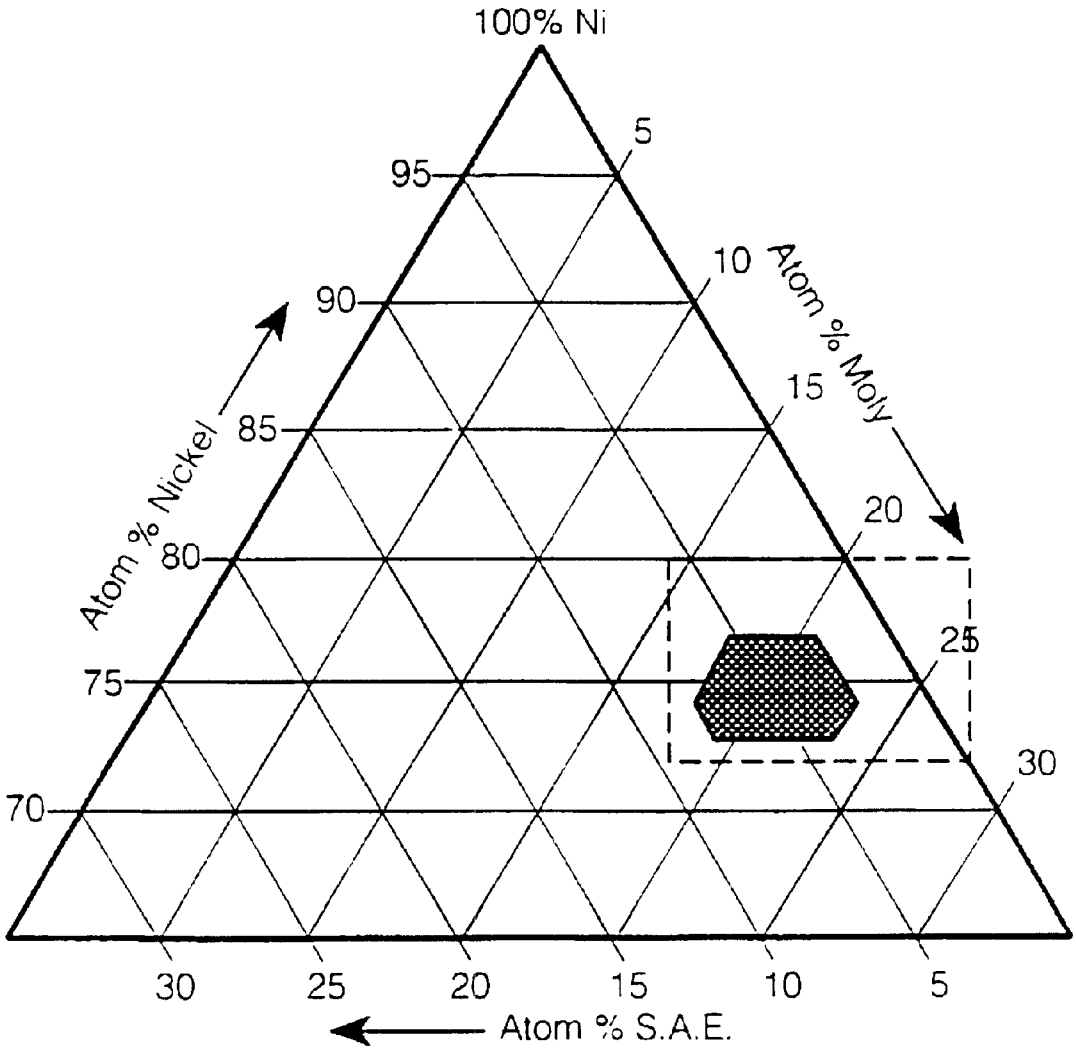
FIG. 1 is a portion of a Ni—Mo—X alloy compositional diagram delineating an area relevant to the present invention.
Figure 2:
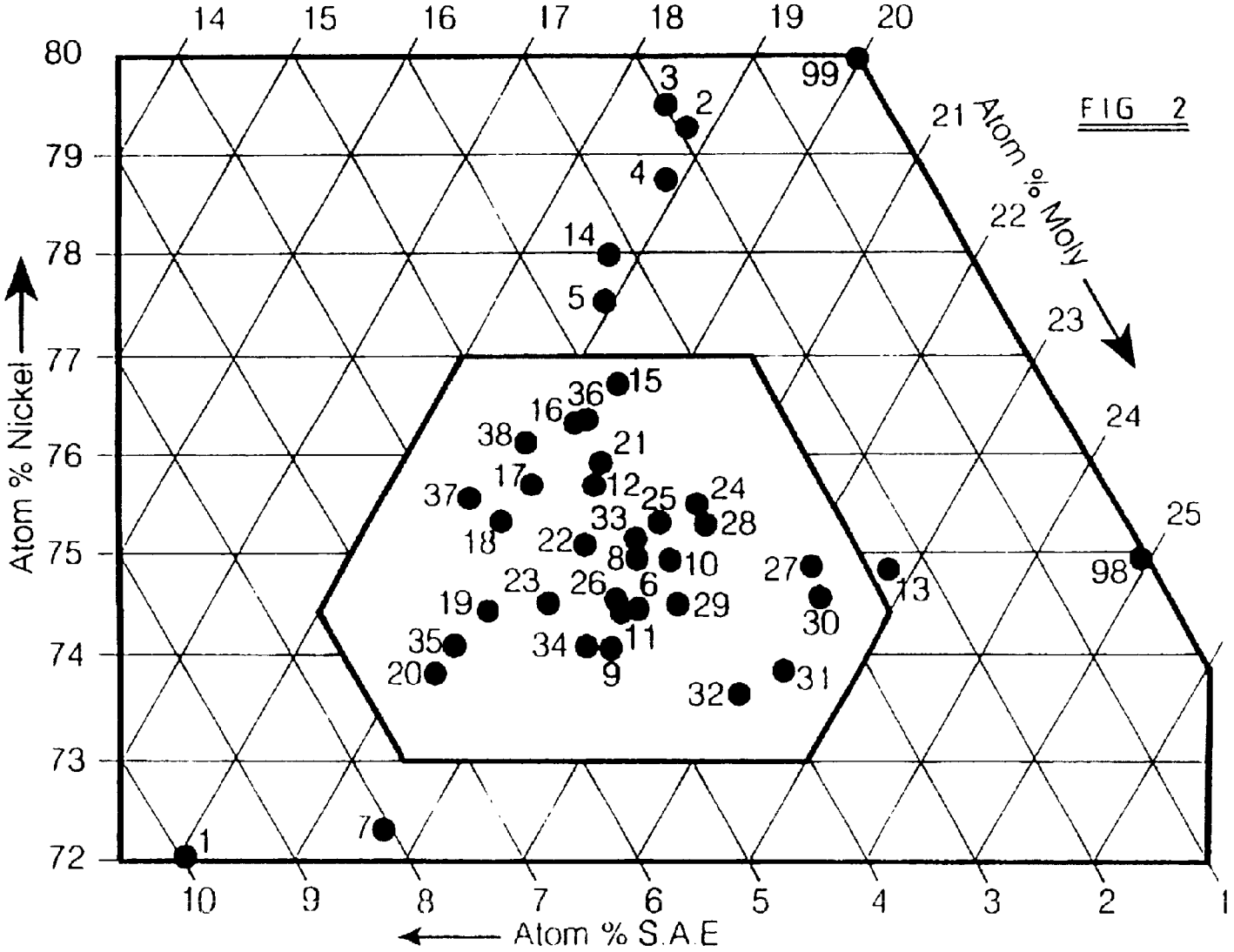
FIG. 2 is an enlarged view of the relevant area delineated in FIG. 1.

Table A sets forth a series of example alloy compositions which were made and evaluated in order to demonstrate some features of the invention. In Table A, example No. 1 is representative of prior art alloy B, examples Nos. 2 to 5 are representative of prior art alloy B-2 and examples Nos. 6 to 38 are experimental alloys serving to suggest the broad scope of the invention. The range of compositions is better illustrated in FIG. 1 and FIG. 2, which graphically show a portion of the Ni—Mo-OTHER compositional diagram. In FIG. 1, the general area of interest is shown within the dotted lines and the more specific area of the present invention is shown cross-hatched. FIG. 2 is an enlarged view of the general area delineated in FIG. 1 and shows the location of the tested compositions, Nos. 1 to 38, within this area. Also shown in FIG. 2 are points 99, corresponding to a composition of $Ni_{80}Mo_{20}$ ($Ni_4Mo$), and 98, corresponding to $Ni_{75}Mo_{25}$ ($Ni_3Mo$), which are very brittle, ordered phases.

Basically, the experimental examples were made by melting the desired amount of alloying elements in a small laboratory vacuum induction furnace while the prior art examples were obtained from commercial melts produced in an air-melt furnace and then argon-oxygen decarburized.

All of the melts were cast into electrodes for subsequent electroslag refining (ESR) into ingots which were later hot worked into slabs then plates, as is well known in the art.

Because these examples were easily prepared, it is expected that this invention may be practiced by most well known conventional techniques used to manufacture superalloys. Furthermore, because the casting and working characteristics of the preferred materials are relatively trouble-free, the invention may be shaped by casting, forging, hot and cold rolling or powder metallurgy techniques.

Here, the hot rolled plates were cold rolled into 1.5 mm thick sheet samples which were homogenized or solution annealed at 1065° C. (950° F.) followed by rapid air cooling prior to evaluation, as described below.

Hardness Testing

Figure 3:
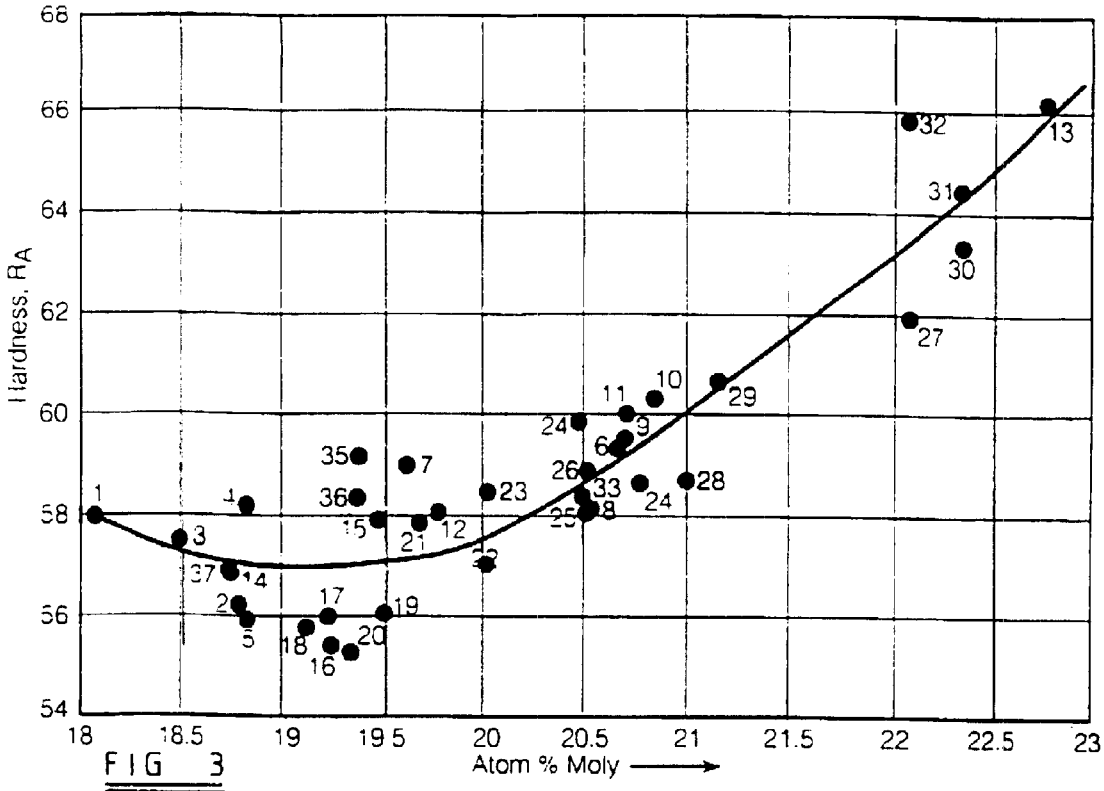
FIG. 3 is a graph of a relationship between alloy hardness and molybdenum content.

Since the thermal stability of these alloys is related to their rate of age hardening and hardness testing is quick and inexpensive, several samples of each of the example alloys, Nos. 1 to 38, were aged at 700° C. (then believed to be the temperature at which age hardening proceeded most rapidly) for various lengths of time from 0.5 hour to 24 hours. The hardness of each sample was measured five times, using the Rockwell "A" scale, and the average value reported in Table B. The results indicate that the initial hardness (i.e., zero aging time) shown graphically in FIG. 3, generally increases with higher molybdenum contents as might be expected. Compare, for example, samples Nos. 5, 15, 24, 28 and 31 which have increasing amounts of molybdenum, but a relatively constant amount (about 3.7 percent) of other elements. The result in Table B also indicate that almost all samples undergo a significant increase in hardness (about 10 or more points) after aging for varying amounts of time; for example, 0.5 hour for samples 2 and 4, one hour for sample 5, two hours for samples 3 and 27, etc.

Figure 4:
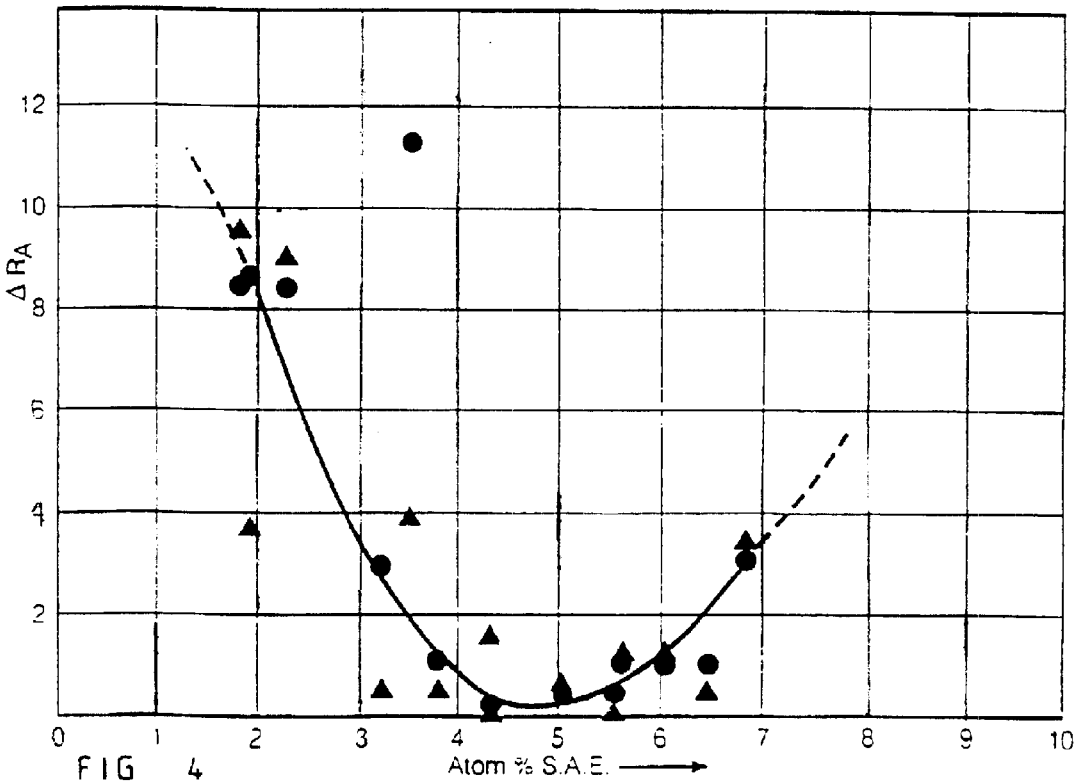
FIG. 4 is a graph of a relationship between the initial rate of age hardening and the amount of substitutional alloying elements (SAE) present.

Quite unexpected, however, is the relationship between the initial hardening rate and the amount of other substitutional alloying elements (SAE) at a relatively constant molybdenum concentration. Samples 2 to 5, 14 to 20 and 35 to 38 have between about 18.5 to 19.5 atom percent molybdenum and from 2 to 7 atom percent other substitutional alloying elements. FIG. 4 plots the difference between the initial hardness and the hardness after 0.5 hour (triangular points) and after 1.0 hour (round points) against the amount of SAE in these samples. It is apparent that the samples which contain more than about 2.5 atom percent but less than about 7.5 atom percent of SAE had a relatively slow hardening rate. In fact, samples 17 and 18, which contain about 5 to 5.5 atom percent SAE, did not significantly harden even after 24 hours at 700° C. These surprising results form the basis of the present invention.

In order to more clearly determine the effects of time and temperature on the hardening rate of the best embodiment of the invention, as compared to the prior art, additional samples of alloy No. 17 and of a commercial B-2 alloy, similar to alloy No. 4, were aged at various temperatures above and below 700° C. for a series of times up to 100 hours.

The results of the hardness measurements are shown in Table C and the data were used to estimate pseudo T-T-T curves for these alloys, as shown in FIG. 5. As is well known in the art, a T-T-T curve generally circumstances the times and temperatures at which a metallographic transformation occurs. In the present case, curve 93 of FIG. 5 circumscribes the times and temperatures at which B-2 alloy age hardens to a value of 60 Ra or greater. Such a hardness is believed to result from a long-range-ordering reaction which forms $Ni_4Mo$ and/or $Ni_3Mo$. Similarly, curves 92 and 91 circumscribe the times and temperatures at which samples of alloy No. 17 hardened to 60 or more because of the formation of $Ni_3Mo$ and/or $Ni_2Mo$. Evidently, the additional alloying elements (SAE) present in alloy No. 17 slows the ordering reaction by stabilizing some of the intermediate phases, such as $Ni_2Mo$. While the exact placement of these curves cannot be assured from such a limited number of tests, the results are sufficient to show the greatly improved thermal stability of the present invention, as compared to the prior art. When heat treating components fabricated from the new alloys, heating or cooling times may safely be about ten times slower than the times recommended for B-2 alloys.

Hot Tensile Testing

While alloy hardness is a quick and easy screening test, it is not adequate to predict an alloy's exact engineering properties during high-temperature working or after age hardening. Therefore, samples of the experimental alloy compositions were cut into standard tensile test specimens, taken in the direction transverse to the sheet rolling direction, for more detailed tests. Duplicate specimens of each alloy were aged at 700° C. for one hour and tensile tested, without cooling (since strain at high temperatures accelerates the ordering transformations), at 700° C. in accordance with the standard recommended practice described in ASTM specification E-21, as is known in the art. The specimens' average percentage elongation, ultimate tensile strength (UTS) and 0.2 percent yield strength (YS) are reported in Table D.

Figure 6:
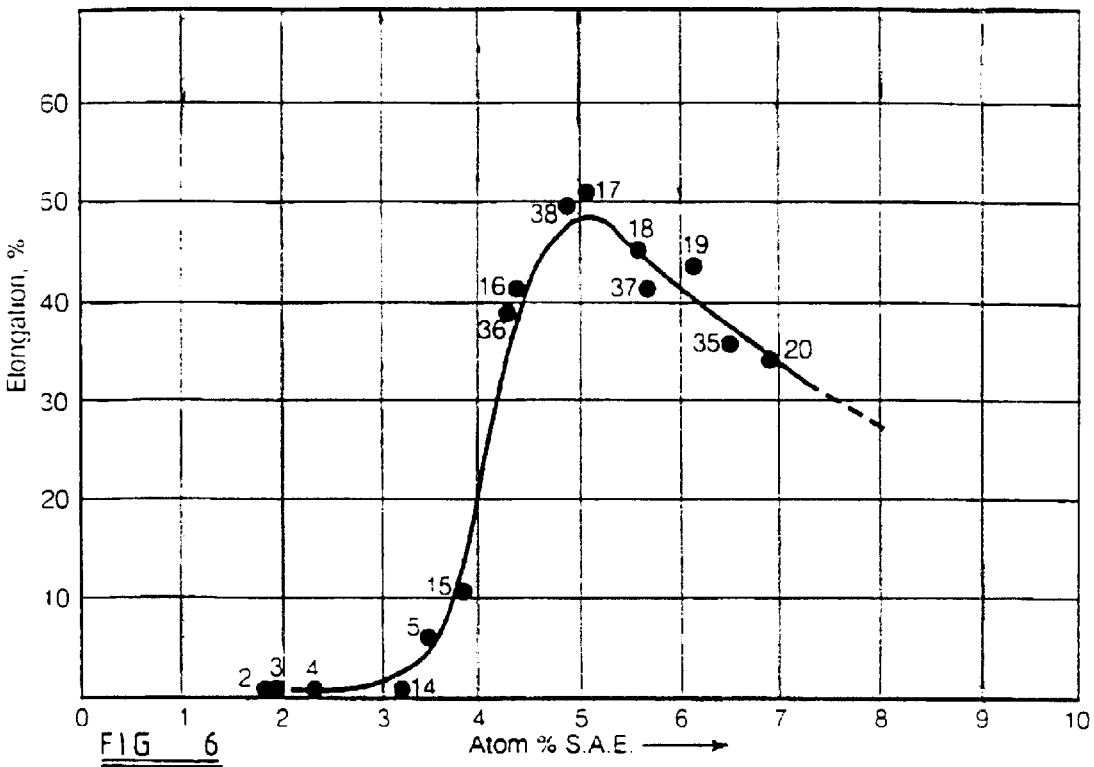
FIG. 6 is a graph of a relationship between 700° C. elongation and the amount of substitutional alloying elements (SAE) present.

FIG. 6 plots the percentage elongation against the amount of substitutional alloying element (SAE) present in the same specimens that were plotted in FIG. 4. It is unexpectedly, apparent that improved ductility is present throughout the compositional ranges as suggested by the hardness test. A most preferred alloy includes more than about 1.2 percent chromium, when the molybdenum content is less than about 20 percent, since those specimens exhibited elongations above about 25 percent.

Table D also indicates that the specimen with higher molybdenum contents (above about 22 percent) have exceptionally high strengths even though their ductility is somewhat low. Therefore, those compositions would be very useful for items (e.g., many castings) in which ductility is not a required characteristic.

FIG. 7 illustrates that a relationship seems to exist between the molybdenum content and the amount of alloying elements needed to obtain good ductility (above about 10 percent). The samples plotted in FIG. 7 seem to lie generally along line 96, which indicates lower total amounts of alloying elements are desirable when the molybdenum content of the alloy increases. The equation of line 96 is: molybdenum equals 27 minus 1.4 times the amount of substitutional alloying elements (SAE), which may be rewritten as SAE+0.7 Mo=19. All the experimental alloys lie within a region defined by SAE+0.7 Mo=17 to 21, and most alloys are between lines 97 and 95, which are defined by SAE+0.7 Mo=18 and 20, respectively. Therefore, the preferred alloys of the present invention contain an amount of substitutional alloying elements for which, when added to 0.7 times the molybdenum content, the total is in the range of 18 to 20 percent.

Corrosion Testing

In order to show that the improved ductility did not harm the corrosion resistance, the relative corrosion rates of the example alloy composition were determined by exposing duplicate 25×50 mm sheet specimens of each to boiling 20% HCl solution for three 96-hour periods. The average rate for the three periods is reported in Table D as mils per year (mpy), which may be converted to mm/yr by multiplying by 0.025.

Figure 8:
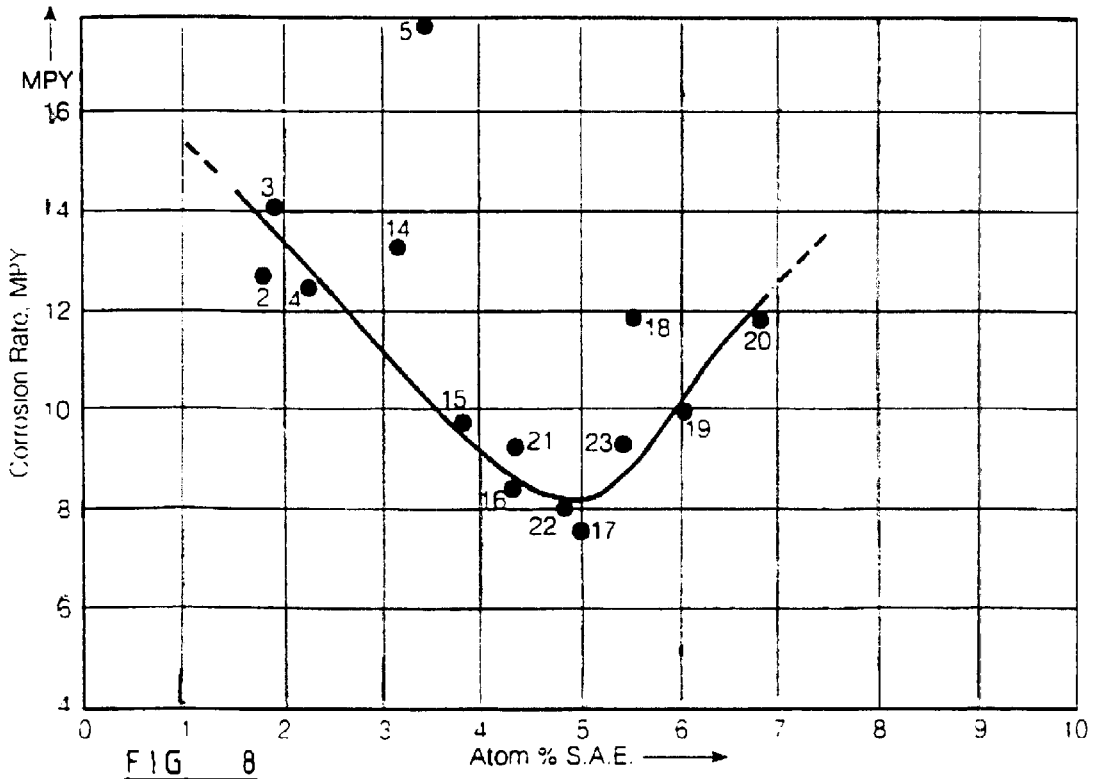
FIG. 8 is a graph of a relationship between corrosion rate and the amount of substitutional alloying elements present.

Table D shows that the corrosion rate of all experimental alloys is much lower than the prior art alloy B (example No. 1) and generally lower than the prior art alloy B-2 examples. Since the corrosion rate of these alloys is known to be affected by the molybdenum content, FIG. 8 illustrates the relationship between the rate and the amount of SAE in those examples which have molybdenum contents between about 18 and 20 atom percent. FIG. 8 shows that the corrosion rate appears to be lowest (below 12 mpy) for those compositions having an SAE content between about 3 and 7 atom percent.

Conclusions

Several observations may be made concerning the general effects of the alloying elements from the foregoing test results (or previous work with similar alloys) as follows:

Aluminum (Al) is an optional substitutional alloying element from Group III of the Periodic Table. It is usually used as a deoxidizer during the melting process and is generally present in the resultant alloy in amounts over about 0.1 percent. Aluminum may also be added to the alloy to increase strength but too much will form detrimental $Ni_3Al$ phases. Preferably, up to about one percent, and more preferably 0.25 to 0.75 percent, of aluminum is present in the alloys of this invention.

Boron (B) is an optional interstitial alloying element which may be unintentionally introduced into the alloy during the melting process (e.g., from scrap or flux) or added as a strengthening element. In the preferred alloys, boron may be present up to about 0.05 percent but, more preferably, less than 0.03 percent for better ductility. Note example No. 13 contains 0.043 percent boron and has very high strength but very low ductility.

Carbon (C) is an undesirable interstitial alloying element which is difficult to eliminate completely from these alloys. It is preferably as low as possible since corrosion resistance falls off rapidly with increasing carbon content. It should not exceed about 0.02 percent, but may be tolerated at somewhat higher levels up to 0.05 percent if less corrosion resistance is acceptable.

Chromium (Cr) is a more preferred substitutional alloying element from Group VI of the Periodic Table. While it may be present from 0 to 5 percent, the most preferred alloys contain about 1 to 4 percent chromium. It seems to form a more stable $Ni_2(Mo,Cr)$ phase in these alloys. Compare experimental alloys, Nos. 15, 16 and 17, which have about 0.6, 1.2 and 1.9 percent chromium and 10, 42 and 52 percent elongations, respectively. At higher concentrations, above about 4 percent, the elongation begins to drop off and the corrosion rate increases.

Cobalt (Co) is a preferred substitutional alloying element from Group VIII of the Periodic Table which is almost always present in nickel-base alloys since it is mutually soluble in the nickel matrix. The alloys of the present invention may contain up to about 5 percent, above which the properties deteriorate. Compare examples Nos. 20, 35 and 7, which have cobalt contents of about 0.5, 3.2 and 5.6 percent and elongations of 35, 36 and 6 percent, respectively.

Copper (Cu) is an undesirable substitutional alloying element from Group I of the Periodic Table. It is often present as an impurity in nickel-base alloys since it is mutually soluble in the nickel matrix. In alloys of the present invention it may be tolerated up to about 0.5 percent but, preferably, is no greater than about 0.1 percent to preserve hot workability.

Iron (Fe) is a preferred substitutional alloying element from Group VIII of the Periodic Table. It is commonly present in these types of alloys since the use of ferro-alloys is convenient for adding other necessary alloying elements. However, as the amount of iron increases, the corrosion rate increases. Compare examples Nos. 31, 11, 34 and 9 which have iron contents of about 1.7, 1.8, 2.9 and 3.2 percent with corrosion rates of 5.9, 6.4, 7.5 and 8.9 mpy, respectively. The preferred alloys of the present invention contain up to about 5 percent iron, but the most preferred alloys contain about 1.5 to 3.5 percent iron.

Manganese (Mn) is a preferred substitutional alloying element from Group VIII of the Periodic Table. It is used herein to improve hot workability and metallurgical stability, and is preferably present in alloys of this invention in amounts up to about 2 percent. The most preferred alloys contain about 0.5 to 1.0 percent manganese.

Molybdenum (Mo) is the major alloying element of the present invention. Amounts greater than about 18 percent are necessary to provide the desired corrosion resistance to the nickel base and amounts greater than 19 percent are preferred. However, amounts greater than about 23 percent are very difficult to hot work into wrought products.

Nickel (Ni) is the base metal of the present invention and must be present in amounts greater than about 72 percent (preferably more than 73 percent), but less than about 78 percent (preferably less than 77 percent), in order to provide adequate physical properties to the alloy. However, the exact amount of nickel present in the alloys of the invention is determined by the required minimum or maximum amounts of molybdenum and other substitutional alloying elements present in the alloy.

Nitrogen (N), Oxygen (O), Phosphorus (P) and Sulphur (S) are all undesirable interstitial alloying elements which, however, are usually present in small amounts in all alloys. While such alloys may be present in amounts up to about 0.1 percent without substantial harm to alloys of the present invention, they are preferably present only up to about 0.02 percent each.

Silicon (Si) is a very undesirable substitutional alloying element from Group IV of the Periodic Table because it has been shown to react strongly with carbon to form, or stabilize, harmful precipitates of complex carbides. While it may be present up to about one percent in alloys of the invention intended for casting less corrosion-resistant articles, the preferred alloys contain no more than about 0.2 percent, and, most preferably, less than about 0.05 percent silicon.

Tungsten (W) is a preferred substitutional alloying element from Group VI of the Periodic Table. Because tungsten is a relatively expensive and heavy element, and it does not seem to help ductility, the preferred alloys should contain only up to about two percent.

Vanadium (V) is a most undesirable substitutional alloying element from Group V of the Periodic Table because it seems to promote the formation of $Ni_3Mo$. Example No. 6, containing about 0.75 percent vanadium, has an elongation at 700° C. of only about 12 percent, whereas example No. 11, with no vanadium but otherwise similar, has an elongation of about 20 percent. Thus, alloys of the present invention may have no more than about one percent and, preferably, less than about 0.8 percent vanadium. Other elements from Group V, e.g., Nb and Ta, are expected to act similarly and should likewise be restricted to less tan one percent.

While, in order to comply with the statutes, this present invention has been described in terms more or less specific to the few preferred embodiments made to date, it is expected that various minor alterations, modifications or permutations thereof will be readily apparent to those skilled in this art. For example, some of the experimental alloys contained small amounts of minor elements (e.g., Ti and Zr) which had no substantial affect on the improved properties of the present invention. Therefore, it should be understood that the invention is not to be limited to the exact compositions shown or described, but it is intended that all equivalents be embraced within the spirit and scope of the invention as defined by the appended claims.

TABLE A

EXAMPLE COMPOSITIONS, ATOMIC PERCENT

| No. | Ni | Mo | Fe | Cr | Mn | AI | Co | W | OTHERS |
|---|---|---|---|---|---|---|---|---|---|
| 1 | 71.961 | 18.044 | 6.67 | 0.99 | 0.72 | 0.31 | 0.35 | — | .04 Cu, .44 Si, 0.46 V |
| 2 | 79.294 | 18.808 | 0.90 | 0.13 | 0.10 | 0.68 | — | — | .03 Cu |
| 3 | 79.495 | 18.496 | 1.03 | — | 0.23 | 0.58 | — | — | .02 Cu, .093 Si |
| 4 | 78.772 | 18.848 | 1.17 | 0.38 | 0.17 | 0.58 | — | — | .03 Cu |
| 5 | 77.572 | 18.850 | 1.56 | 0.74 | 0.15 | 0.73 | 0.17 | — | .06 Cu, .093 Si, |
| 6 | 74.484 | 20.706 | 1.74 | 0.69 | 0.54 | 0.54 | 0.49 | — | .031 B, 0.76 V |
| 7 | 72.268 | 19.659 | 1.26 | 0.01 | 0.04 | 0.20 | 5.59 | .92 | 0.03 V |
| 8 | 73.891 | 20.579 | 1.79 | 1.22 | 0.57 | 0.42 | 0.48 | — | .031 B |
| 9 | 74.041 | 20.716 | 3.16 | 0.61 | 0.54 | 0.39 | 0.48 | — | |
| 10 | 74.875 | 20.846 | 1.84 | 0.59 | 0.54 | 0.51 | 0.48 | — | .037 B, 0.26 Ti |
| 11 | 74.486 | 20.711 | 1.78 | 0.61 | 1.54 | 0.37 | 0.46 | — | |
| 12 | 75.700 | 19.784 | 1.79 | 1.21 | 0.59 | 0.39 | 0.48 | — | |
| 13 | 74.804 | 22.772 | 1.22 | 0.40 | 0.34 | 0.37 | — | — | .043 B, .015 Zr |
| 14 | 77.945 | 18.765 | 1.86 | — | 0.54 | 0.34 | 0.50 | — | .014 Zr |
| 15 | 76.679 | 19.474 | 1.75 | 0.64 | 0.54 | 0.39 | 0.48 | — | |
| 16 | 76.348 | 19.251 | 1.71 | 1.20 | 0.51 | 0.41 | 0.49 | — | 0.03 V |
| 17 | 75.667 | 19.260 | 1.72 | 1.87 | 0.55 | 0.41 | 0.47 | — | |
| 18 | 75.270 | 19.143 | 1.69 | 2.45 | 0.55 | 0.39 | 0.47 | — | |
| 19 | 74.365 | 19.513 | 1.63 | 3.04 | 0.54 | 0.41 | 0.47 | — | |
| 20 | 73.805 | 19.341 | 1.62 | 3.75 | 0.56 | 0.44 | 0.46 | — | |
| 21 | 75.903 | 19.678 | 1.72 | 1.31 | 0.56 | 0.75 | — | — | .03 Cu |
| 22 | 75.047 | 20.025 | 1.67 | 1.88 | 0.55 | 0.78 | — | — | |
| 23 | 74.463 | 20.006 | 1.67 | 2.51 | 0.56 | 0.73 | — | — | |
| 24 | 75.464 | 20.790 | 1.72 | 0.67 | 0.54 | 0.78 | — | — | |
| 25 | 75.268 | 20.557 | 1.68 | 1.27 | 0.52 | 0.68 | — | — | |
| 26 | 74.553 | 20.557 | 1.66 | 1.89 | 0.55 | 0.76 | — | — | |
| 27 | 74.900 | 22.097 | 1.68 | — | 0.55 | 0.74 | — | — | .022 Zr |
| 28 | 75.238 | 20.996 | 1.71 | 0.71 | 0.54 | 0.78 | — | — | .022 Zr |
| 29 | 74.492 | 21.153 | 1.67 | 1.31 | 0.55 | 0.78 | — | — | .022 Zr |
| 30 | 74.567 | 22.352 | 1.71 | — | 0.55 | 0.79 | — | — | .022 Zr |
| 31 | 73.865 | 22.353 | 1.69 | 0.67 | 0.55 | 0.84 | — | — | .022 Zr |
| 32 | 73.599 | 22.144 | 1.64 | 1.28 | 0.56 | 0.74 | — | — | .022 Zr |
| 33 | 75.058 | 20.447 | 2.82 | 0.05 | 0.02 | 0.65 | — | .93 | |
| 34 | 74.121 | 20.477 | 2.89 | 0.79 | 0.02 | 0.72 | — | .89 | |
| 35 | 74.141 | 19.380 | <0.1 | 1.85 | 0.55 | 0.83 | 3.20 | — | |
| 36 | 76.372 | 19.342 | <0.1 | 1.85 | 0.56 | 0.78 | 0.72 | .34 | |
| 37 | 75.564 | 18.758 | 2.02 | 1.16 | 1.00 | 0.58 | 0.65 | .19 | |
| 38 | 76.084 | 19.005 | 1.61 | 1.83 | 0.61 | 0.70 | — | — | .12 Si |

NOTE: Unless otherwise indicated, each sample contained less than: 0.03 B, 0.02 C, 0.01 Cu, 001 P, 0.005 S, 0.05 Si, 0.01 V, 0.01 Zr

TABLE B

HARDNESS (RA) VS AGING TIME (HOURS) AT 700° C.

| No. | 0 | 0.5 | 1.0 | 2.0 | 4.0 | 8.0 | 24 |
|---|---|---|---|---|---|---|---|
| 1 | 58.0 | 58.4 | 58.7 | 58.9 | 58.6 | 59.0 | 59.3 |
| 2 | 56.3 | 65.9 | 64.9 | 67.2 | 66.9 | 69.1 | 69.0 |
| 3 | 57.5 | 61.2 | 66.3 | 67.0 | 67.8 | 67.9 | 69.2 |
| 4 | 58.2 | 67.3 | 66.8 | 68.1 | 68.6 | 69.3 | 70.5 |
| 5 | 55.9 | 59.8 | 67.3 | 67.5 | 68.0 | 67.9 | 68.8 |
| 6 | 59.3 | 65.1 | 66.9 | 67.7 | 74.8 | 74.7 | 75.0 |
| 7 | 59.0 | 59.7 | 60.9 | 65.1 | 66.5 | 67.6 | 68.0 |
| 8 | 58.2 | 58.6 | 60.1 | 61.3 | 66.5 | 70.4 | 72.1 |
| 9 | 59.5 | 58.3 | 58.7 | 60.0 | 66.1 | 67.7 | 73.0 |
| 10 | 60.3 | 61.5 | 64.2 | 67.8 | 72.2 | 75.1 | 75.0 |
| 11 | 60.0 | 61.5 | 65.0 | 66.9 | 72.8 | 75.2 | 74.6 |
| 12 | 58.1 | 57.8 | 59.3 | 60.3 | 66.5 | 68.5 | 68.7 |

TABLE B-continued

HARDNESS (RA) VS AGING TIME (HOURS) AT 700° C.

| No. | 0 | 0.5 | 1.0 | 2.0 | 4.0 | 8.0 | 24 |
|---|---|---|---|---|---|---|---|
| 13 | 66.2 | 71.0 | 71.9 | 75.2 | 76.1 | 76.1 | 76.6 |
| 14 | 56.8 | 57.3 | 59.8 | 62.3 | 63.8 | 65.7 | 66.6 |

TABLE B-continued

HARDNESS (RA) VS AGING TIME (HOURS) AT 700° C.

| No. | 0 | 0.5 | 1.0 | 2.0 | 4.0 | 8.0 | 24 |
|---|---|---|---|---|---|---|---|
| 15 | 57.9 | 58.4 | 59.1 | 64.9 | 66.4 | 66.8 | 67.7 |
| 16 | 55.4 | 57.1 | 55.6 | 58.9 | 63.9 | 65.8 | 67.5 |
| 17 | 56.0 | 56.5 | 56.5 | 56.2 | 56.6 | 57.0 | 57.1 |
| 18 | 55.8 | 55.6 | 56.3 | 56.3 | 57.1 | 56.7 | 58.3 |
| 19 | 56.0 | 57.3 | 57.0 | 61.2 | 64.8 | 65.7 | 68.7 |
| 20 | 55.3 | 58.9 | 58.4 | 63.6 | 64.9 | 66.0 | 67.6 |
| 21 | 57.8 | 58.9 | 59.6 | 59.3 | 58.5 | 64.7 | 69.7 |
| 22 | 57.1 | 58.4 | 60.1 | 63.4 | 65.3 | 66.9 | 69.2 |
| 23 | 58.5 | 61.3 | 64.1 | 65.8 | 66.3 | 67.1 | 71.9 |
| 24 | 58.7 | 60.4 | 64.1 | 65.3 | 67.3 | 69.6 | 70.8 |
| 25 | 58.1 | 61.0 | 64.7 | 65.9 | 67.3 | 69.3 | 73.6 |
| 26 | 58.9 | 66.5 | 67.0 | 67.6 | 67.6 | 71.7 | 74.9 |

TABLE B-continued

HARDNESS (RA) VS AGING TIME (HOURS) AT 700° C.

| No. | 0 | 0.5 | 1.0 | 2.0 | 4.0 | 8.0 | 24 |
|---|---|---|---|---|---|---|---|
| 27 | 61.9 | 68.4 | 69.4 | 71.8 | 74.9 | 76.8 | 75.7 |
| 28 | 58.7 | 65.6 | 66.4 | 66.4 | 68.6 | 74.3 | 74.5 |
| 29 | 60.7 | 67.5 | 67.6 | 68.5 | 69.8 | 75.3 | 74.7 |
| 30 | 63.3 | 69.5 | 69.8 | 73.0 | 75.9 | 76.7 | 76.8 |
| 31 | 64.5 | 70.1 | 70.9 | 73.2 | 75.0 | 76.0 | 76.3 |
| 32 | 65.9 | 70.4 | 72.0 | 72.9 | 75.5 | 77.5 | 77.7 |
| 33 | 58.4 | 59.8 | 61.6 | 63.8 | 68.6 | 71.1 | 71.4 |
| 34 | 59.9 | 63.2 | 66.5 | 67.1 | 68.7 | 71.5 | 72.7 |
| 35 | 59.2 | 59.7 | 60.2 | 59.5 | 59.7 | 60.8 | 70.9 |
| 36 | 58.3 | 58.3 | 58.6 | 58.7 | 58.8 | 61.2 | 71.5 |
| 37 | 56.9 | 58.2 | 58.0 | 58.1 | 58.2 | 57.7 | 59.1 |

Average of 5 measurements

TABLE C

HARDNESS (RA) VS AGING TEMPERATURES (° C.) AND TIME (HRS)

| AGE | AGING TIME IN HOURS | | | | | | | | |
|---|---|---|---|---|---|---|---|---|---|
| TEMP | 0.2 | 0.5 | 1 | 2 | 4 | 8 | 24 | 48 | 100 |
| DATA FOR HEAT 9-6231 (No. 4) | | | | | | | | | |
| 600° | — | 58.0 | 59.2 | 59.3 | 59.9 | 60.1 | 61.6 | 62.6 | 63.5 |
| 650° | — | 59.4 | 60.1 | 60.9 | 64.1 | 65.0 | 65.6 | 66.6 | 69.0 |
| 700° | 59.3 | 66.1 | 67.5 | 67.7 | 68.7 | 69.0 | 69.6 | 70.2 | 69.7 |
| 750° | 59.0 | 65.5 | 68.7 | 69.9 | 69.2 | 70.0 | 69.7 | 69.5 | 69.8 |
| 800° | — | 57.6 | 57.6 | 58.0 | 57.4 | 57.3 | 61.0 | 60.2 | 63.0 |
| 850° | — | 57.7 | 57.8 | 57.8 | 57.6 | 57.2 | 57.7 | 57.8 | 56.8 |
| 900° | — | 58.1 | 58.1 | 58.2 | 58.4 | 58.1 | 56.7 | 57.6 | 57.3 |
| DATA FOR HEAT EN 5190 (No. 17) | | | | | | | | | |
| 600° | — | 55.9 | 56.4 | 57.2 | 57.3 | 58.0 | 59.3 | 60.4 | 62.1 |
| 650° | — | 56.5 | 56.5 | 56.1 | 56.8 | 59.4 | 66.2 | 67.1 | 68.2 |
| 700° | — | 56.0 | 56.5 | 56.5 | 56.2 | 56.6 | 57.0 | 60.7 | 70.7 |
| 750° | — | 55.5 | 56.1 | 57.0 | 56.2 | 56.7 | 64.1 | 70.5 | 71.4 |
| 800° | — | 55.9 | 56.2 | 56.1 | 56.2 | 56.2 | 61.1 | 66.5 | 68.5 |
| 850° | — | 55.2 | 54.8 | 55.3 | 55.7 | 55.0 | 55.4 | 55.9 | 55.9 |
| 900° | — | 55.2 | 54.8 | 55.0 | 54.9 | 54.7 | 54.8 | 54.4 | 54.6 |

TABLE D

DATA AND TEST RESULTS

| No. | MATERIAL I.D. | HCL CORR. RATE MPY* | 700° C. 1 HR. % ELONG | 700° C. UTS KSI** | 700° C. .2% YS KSI** | SUM AT % |
|---|---|---|---|---|---|---|
| 1 | 2620-6-0305 | 36.2 | 56.1 | 120.7 | 50.5 | 9.98 |
| 2 | 2665-4-6248 | 12.7 | 1.1 | 64.8 | — | 1.84 |
| 3 | 2665-0-6303 | 14.1 | 1.2 | 72.9 | — | 1.95 |
| 4 | 2665-3-6222 | 12.4 | 1.1 | 72.6 | — | 2.33 |
| 5 | 2665-9-6263 | 17.9 | 6.4 | 68.8 | — | 3.50 |
| 6 | EN 7489 | 8.7 | 11.8 | 103.2 | 84.2 | 4.76 |
| 7 | EN 7889 | 10.1 | 6.2 | 66.5 | 54.3 | 8.05 |
| 8 | EN 8889 | 9.6 | 36.3 | 102.7 | 50.0 | 4.48 |
| 9 | EN 8989 | 8.9 | 34.8 | 105.3 | 49.4 | 5.18 |
| 10 | EN 9089 | 7.4 | 23.5 | 104.5 | 64.4 | 4.22 |
| 11 | EN 9189 | 6.4 | 19.9 | 102.0 | 66.6 | 4.76 |
| 12 | EN 9289 | 12.0 | 27.9 | 85.4 | 44.2 | 4.46 |
| 13 | EN 9389 | 4.6 | 1.7 | 137.2 | 108.0 | 2.35 |
| 14 | EN 4890 | 13.3 | 1.3 | 78.0 | 78.0 | 3.25 |
| 15 | EN 4990 | 9.8 | 10.3 | 78.4 | 59.8 | 3.80 |
| 16 | EN 5090 | 8.4 | 41.7 | 95.1 | 41.3 | 4.35 |
| 17 | EN 5190 | 7.7 | 52.3 | 105.4 | 42.2 | 5.02 |
| 18 | EN 5290 | 11.9 | 46.0 | 97.6 | 39.2 | 5.55 |
| 19 | EN 5390 | 10.0 | 43.7 | 100.4 | 43.0 | 6.09 |
| 20 | EN 5490 | 11.9 | 34.7 | 97.7 | 47.0 | 6.83 |

TABLE D-continued

DATA AND TEST RESULTS

| No. | MATERIAL I.D. | HCL CORR. RATE MPY* | 700° C. 1 HR. % ELONG | 700° C. UTS KSI** | 700° C. .2% YS KSI** | SUM AT % |
|---|---|---|---|---|---|---|
| 21 | EN 8090 | 9.3 | 32.2 | 105.1 | 51.4 | 4.37 |
| 22 | EN 8190 | 8.0 | 37.4 | 102.5 | 48.5 | 4.88 |
| 23 | EN 8290 | 9.4 | 26.6 | 112.7 | 68.8 | 5.47 |
| 24 | EN 8390 | 6.3 | 23.0 | 104.0 | 65.2 | 3.71 |
| 25 | EN 8490 | 7.8 | 19.2 | 104.9 | 70.4 | 4.15 |
| 26 | EN 8590 | 7.6 | 15.1 | 111.3 | 79.7 | 4.86 |
| 27 | EN 8690 | 5.5 | 6.8 | 106.8 | 88.4 | 2.99 |
| 28 | EN 8790 | 7.0 | 14.0 | 103.7 | 78.4 | 3.71 |
| 29 | EN 8890 | 7.4 | 12.2 | 112.9 | 84.3 | 4.35 |
| 30 | EN 8990 | 5.3 | 6.7 | 119.7 | 95.7 | 3.07 |
| 31 | EN 9090 | 5.9 | 5.9 | 123.7 | 102.2 | 3.77 |
| 32 | EN 9190 | 13.2 | 5.3 | 134.5 | 107.0 | 4.24 |
| 33 | EN 9290 | 10.1 | 30.8 | 103.4 | 55.4 | 4.47 |
| 34 | EN 9390 | 7.5 | 19.4 | 113.5 | 77.7 | 5.31 |
| 35 | EN 5091 | 13.9 | 36.3 | 104.1 | 47.9 | 6.48 |
| 36 | EN 5191 | 10.3 | 38.7 | 102.0 | 49.2 | 4.30 |
| 37 | 2665-1-6311 | 10.9 | 41.4 | 103.6 | 47.6 | 5.61 |
| 38 | 2675-1-6650 | — | 50.0 | 114.0 | 50.0 | 4.87 |

*Multiply MPY 0.025 to obtain mm/yr.
**Multiply KSI by 6.89 to Obtain MPa

What is claimed is:

1. A process for improving the thermal stability of nickel-base molybdenum alloys comprising the steps of:

a) forming a molten mass of nickel-base alloy containing at least about 18 atom percent molybdenum, one or more interstitial elements selected from the group consisting of B, C, N, O, P and S, not exceeding about 0.1 atom percent for any one such element, and small amounts of other manufacturing alloying elements;

b) analyzing a representative sample of the molten mass to determine the chemical composition thereof, c) calculating the sum total of alloying elements Cr, W, Mn, Fe, Co, Al, Cu, Si, Ti, V and Zr present in the molten mass;

d) determining an amount of additional alloying materials which must be added to the molten mass in order to adjust said sum total to be within the range of about 2.5 to 7.5 atom percent and said sum, plus 0.7 times the molybdenum concentration, to be in the range of 17 to 21 atom percent, none of Cr, W, Mn, Fe and Co exceeds five atom percent, and none of Al, Cu, Si, Ti, V and Zr exceeds one atom percent;

e) adding said amount of additional alloying elements selected from the group consisting of Cr, W, Mn, Fe, Co, Al, Cu, Si, Ti, V and Zr and mixtures thereof to the molten mass; and (f) forming the molten mass into products.

2. The process of claim 1 wherein step (f) includes the steps of:

a) casting the molten mass into an electrode;

b) electroslag remelting the electrodes into one ingot;

c) hot forging the ingot into a slab; and d) hot rolling the slab into plate.

3. The process of claim 2 further including the step of cold rolling the plate into sheet.

4. The product produced by the process of claim 3 characterized by having a tensile elongation, when measured after molding at 700° C. for one hour, of greater than 25 percent.

5. The product produced by the process of claim 3 characterized by having a corrosion rate, when measured in boiling 20% HCl of less than about 15 mils per year.

6. The process of claim 1 also comprising adding an amount of at least one interstitial element selected from the group consisting of B, C, N, O, P and S such that no interstitial element exceeds about 0.1 atom percent of the molten mass.

* * * * *